United States Patent [19]

Nishimura et al.

[11] 4,422,874

[45] Dec. 27, 1983

[54] GOLDEN SINTERED ALLOY FOR ORNAMENTAL PURPOSE

[75] Inventors: Tomio Nishimura; Hiraku Yoshino; Kosei Takao; Yuuji Masumoto, all of Fukuoka, Japan

[73] Assignee: Nippon Tungsten Co., Ltd., Fukuoka, Japan

[21] Appl. No.: 337,223

[22] Filed: Jan. 6, 1982

[30] Foreign Application Priority Data

Oct. 9, 1981 [JP] Japan ..... 56-161146
Oct. 9, 1981 [JP] Japan ..... 56-161147
Oct. 9, 1981 [JP] Japan ..... 56-161148

[51] Int. Cl.[3] ..... B22F 1/00
[52] U.S. Cl. ..... 75/238; 75/239
[58] Field of Search ..... 75/238, 236, 237, 239

[56] References Cited

FOREIGN PATENT DOCUMENTS 1591774 6/1970 France .
53-13567 5/1978 Japan .

*Primary Examiner*—Benjamin R. Padgett
*Assistant Examiner*—Anne Brookes
*Attorney, Agent, or Firm*—Jordan and Hamburg

[57] ABSTRACT

The present invention relates to a method for producing golden sintered alloys for ornamental purposes and suitable for use in watches. They are mainly composed of 10–40 percent by weight of titanium nitride, 10–30 percent by weight of nickel and valanced niobium carbide. Less than 40 percent by weight of the nickel may be substituted by at least one member from the group of chromium, molybdenum, tungsten and titanium. The alloys have a high degree of hardness (Rockwell A scale), excellent corrosion resistance and a beautiful gold color.

2 Claims, No Drawings

GOLDEN SINTERED ALLOY FOR ORNAMENTAL PURPOSE

BACKGROUND OF THE INVENTION

This invention relates to a method for producing golden sintered alloy for ornamental purposes which is used on watches. The alloy is mainly comprised of niobium carbide and is characterized by nonmagnetism and a gold color.

DESCRIPTION OF THE PRIOR ART

As golden sintered alloys, tantalum carbide alloys and niobium carbide alloys are well known. Tantalum carbide alloys possess a high order of resistance to corrosion and the tone of color is gold, but the cost of materials is too expensive. Niobium carbide alloys are inferior to tantalum carbide alloys in the degree of corrosion resistance, and the tone of color is not gold, but is grayish white. There are titanium nitride alloys which are satisfactory as to the corrosion resistance, the tone of color and the cost of materials, but the wettability with bonding materials is unsatisfactory and it is difficult to get minute, strong sintered alloys.

SUMMARY OF THE INVENTION

It is an object of the present invention to provide a sintered alloy for ornamental purposes having a high minuteness, a high degree of hardness, an excellent corrosion resistance and a high degree of transverse rupture strength. The above-mentioned golden sintered alloy consists essentially of; 30–80 percent by weight of valanced niobium carbide, 10–40 percent by weight of titanium nitride and 10–30 percent by weight of nickel. Less than 40 percent by weight of the nickel can be substituted by at least one member from the group of chromium, molybdenum, tungsten and titanium.

DETAILED DESCRIPTION OF PREFERRED EMBODIMENTS

EXAMPLE I

Niobium carbide having a mean particle size of 1.5 μm, titanium nitride having a mean particle size of 1.5 μm, nickel having a mean particle size of 1.3 μm and molybdenum having a mean particle size of 1.3 μm were mixed in various mixing ratios by wet ball milling for 120 hours as shown in Table 1. Subsequently, the paraffin was added to mixture after drying and the mixture was granulated and molded at a pressure of 1.5 ton/cm$^2$ so that the green compact had a size of 5.5 mm×10 mm×30 mm. Then, the green compact which was formed in the above manner was presintered in a vacuum furnace at 800° C. And after removing the paraffin, the presintered body was sintered at various temeratures under a pressure of $5\times10^{-2}$ mmHg for 60 minutes as shown in Table 1. Subsequently, the sintered body was shaped by a diamond grinder and the hardness (Rockwell A scale) and the transverse rupture strength of the ground sintered body were measured. The above-mentioned sintered body was further lapped after grinding by a diamond grinder, and the corrosion resistance and the tone of color were observed. In the corrosion-resistance test, the degree of tarnish in the lapping surface was observed after immersion in artificial sweat for 48 hours. The artificial sweat consisted of the following:

NaCl 20g/l, $NH_4Cl$ 17.5g/l, $CO(NH_2)_2$5g/l, $CH_3COOH$ 2.5 g/l and $CH_3CH(OH)COOH$ 15g/l were mixed with NaOH to pH 4.7.

The result of the above-mentioned experiment is shown in the following Table 1.

TABLE 1

| | mixing component (percent by weight) | | | | sintering temperature | hardness | transverse rupture strength | corrosion | tone of |
|---|---|---|---|---|---|---|---|---|---|
| | NbC | TiN | Ni | Mo | °C. | $H_RA$ | Kg/mm$^2$ | resistance | color |
| alloys of | 80 | 10 | 10 | | 1,400 | 88.0 | 115 | good | gold color |
| the present | 70 | 10 | 20 | | 1,360 | 87.5 | 135 | good | gold color |
| invention | 60 | 15 | 25 | | 1,360 | 87.0 | 135 | good | gold color |
| | 60 | 20 | 20 | | 1,380 | 88.0 | 130 | good | gold color |
| | 55 | 20 | 25 | | 1,380 | 88.0 | 140 | good | gold color |
| | 50 | 20 | 30 | | 1,380 | 88.5 | 145 | good | gold color |
| | 50 | 25 | 25 | | 1,400 | 88.5 | 140 | good | gold color |
| | 40 | 30 | 30 | | 1,400 | 87.0 | 130 | good | gold color |
| | 40 | 35 | 25 | | 1,420 | 87.5 | 125 | good | gold color |
| | 30 | 40 | 30 | | 1,420 | 87.0 | 125 | good | gold color |
| comparative | 80 | | 15 | | 1,350 | 88.0 | 130 | slightly inadequate | grayish-white color |
| specimen | 90 | | 10 | | 1,390 | 89.0 | 110 | slightly inadequate | grayish-white color |

EXAMPLE II

Niobium carbide having a mean particle size of 1.5 μm, titanium nitride having a mean particle size of 1.5 μm, nickel having a mean particle size of 1.3 μm, chromium having a mean particle size of 3.5 μm, molybdenum having a mean particle size of 1.5 μm, tungsten having a mean particle size of 1.5 μm and titanium of less than 325 mesh were mixed in various mixing ratios by wet ball milling for 120 hours as shown in Table 2. Subsequently, paraffin was added to the mixture after drying, and the mixture was granulated and molded at a pressure of 1.5 ton/cm$^2$ so that the green compact had a size of 5.5 mm×10 mm×30 mm. Then, the green compact which was formed in the above manner was presintered in a vacuum furnace at 800° C. After removing paraffin, the presintered body was sintered at various temperatures under a pressure of $5\times10^{-2}$ mmHg for 60 minutes as shown in Table 2. Subsequently, the sintered body was shaped by a diamond grinder and the hardness (Rockwell A scale) and the transverse rupture strength were measured. The above-mentioned sintered body was further lapped after grinding by a diamond grinder, and the corrosion resistance and the tone of color were observed. In the same way as in Example I in the corrosion-resistance test, the degree of tarnish in the lapping surface was observed after immersing in artificial sweat for 28 hours. The result of the above-mentioned experiment is shown in the following Table 2.

TABLE 2

| | mixing component (percent by weight) | | | | | | | sintering temperature | hardness | transverse rupture strength | corrosion | tone of |
|---|---|---|---|---|---|---|---|---|---|---|---|---|
| | NbC | TiN | Ni | Cr | Mo | W | Ti | °C. | $H_RA$ | Kg/mm$^2$ | resistance | color |
| alloys of the present invention | 80 | 10 | 9.0 | 1.0 | | | | 1,410 | 88.0 | 110 | good | gold color |
| | 80 | 10 | 8.5 | 0.5 | 0.5 | 0.5 | | 1,410 | 87.5 | 105 | good | gold color |
| | 70 | 10 | 17 | 1.5 | 1.5 | | | 1,370 | 88.0 | 130 | good | gold color |
| | 70 | 10 | 15 | 1.5 | 1.5 | 1.0 | 1.0 | 1,390 | 87.5 | 120 | good | gold color |
| | 60 | 15 | 22 | 1.5 | 1.5 | | | 1,370 | 87.5 | 135 | good | gold color |
| | 60 | 15 | 19 | 1.5 | 1.5 | 1.5 | 1.5 | 1,390 | 87.5 | 120 | good | gold color |
| | 60 | 20 | 18 | | 2.0 | | | 1,390 | 88.0 | 125 | good | gold color |
| | 60 | 20 | 16 | 1.0 | 1.0 | | 2.0 | 1,410 | 88.0 | 115 | good | gold color |
| | 55 | 20 | 21 | 2.0 | 2.0 | | | 1,390 | 88.5 | 130 | good | gold color |
| | 55 | 20 | 19 | 1.5 | 1.5 | 1.5 | 1.5 | 1,410 | 88.5 | 125 | good | gold color |
| | 55 | 20 | 23 | 2.0 | | | | 1,370 | 88.5 | 135 | good | gold color |
| | 50 | 20 | 22 | 2.0 | 2.0 | 2.0 | 2.0 | 1,410 | 88.0 | 125 | good | gold color |
| | 50 | 25 | 23 | | 2.0 | | | 1,400 | 88.0 | 130 | good | gold color |
| | 50 | 25 | 21 | 1.0 | 1.0 | | 2.0 | 1,410 | 88.5 | 120 | good | gold color |
| | 40 | 30 | 26 | 2.0 | 2.0 | | | 1,410 | 87.0 | 125 | good | gold color |
| | 40 | 30 | 25 | 1.5 | 1.5 | 2.0 | | 1,410 | 87.5 | 120 | good | gold color |
| | 40 | 35 | 22 | 1.5 | 1.5 | | | 1,430 | 88.0 | 120 | good | gold color |
| | 40 | 35 | 21 | 1.0 | 1.0 | 1.0 | 1.0 | 1,430 | 87.5 | 115 | good | gold color |
| | 30 | 40 | 27 | 1.5 | 1.5 | | | 1,430 | 87.5 | 125 | good | gold color |
| | 30 | 40 | 25 | 1.0 | 1.0 | 1.5 | 1.5 | 1,430 | 87.0 | 115 | good | gold color |
| comparative specimens | 80 | | 15 | | 5.0 | | | 1,350 | 88.0 | 130 | slightly inadequate | grayish-white color |
| | 80 | | 15 | | 5.0 | | | 1,350 | 88.0 | 130 | slightly inadequate | grayish-white color |
| | 90 | | 10 | | | | | 1,390 | 89.0 | 110 | slightly inadequate | grayish-white color |
| | 90 | | 10 | | | | | 1,390 | 89.0 | 110 | slightly inadequate | grayish-white color |

The reason for using 10–40 percent by weight of the titanum nitride in the alloys of the present invention is as follows:

The tone of becomes grayish white color in the case of less than 10 percent by weight, and the alloy has poor corrosion resistance. In the case of more than 40 percent by weight, the sinterability becomes lower, and the minuteness and the transverse rupture strength become lower, too. The reason for using 10–30 percent by weight of nickel as the bonding material is as follows:

In the case of less than 10 percent by weight, the toughness of the sintered alloy is not enough to be practical, and, in the case of more than 30 percent by weight, the hardness (Rockwell A scale) is lowered. Additionally, as bonding materials, nickel can be substituted by at least one member from the group of chromium, molybdenum, tungsten and titanium. Chromium and molybdenum improve the corrosion resistance, while tungsten and titanium improve the sintering and enable the production of minute sintered alloys. When the above-mentioned bonding materials are used with the nickel, they are effective in minute amounts, but larger amounts of bonding materials are undesirable because the toughness of the alloys becomes lower with decreasing of the nickel content. For the latter reason, the content of substitute bonding materials which is less than 40 percent by weight of the nickel is desirable. The alloys of the present invention compare favorably with the hard alloys with regard to hardness and transverse rupture strength (for example, in the case of the hard alloys consisting of WC-5Co, the hardness of $H_RA$ 93–94, and the transverse rupture strength is 100–160 Kg/mm$^2$) have an excellent corrosion resistance and are suitable for ornamental purposes because of their beautiful gold color. Also the present alloys are characterized by nonmagnetism and a specific weight of only 8 at normal temperature. These alloys are inexpensive and are light compared with tantalum carbide which has a specific weight of more than 14. For the above-mentioned reasons, the alloys of the present invention are especially excellent as materials for use in watches.

What we claim is:

1. Gold colored sintered alloy for ornamental purposes consisting essentially of:

30–80 percent by weight of niobium carbide, 10–40 percent by weight of titanium nitride and 10–30 percent by weight of nickel.

2. Golden sintered alloy according to claim 1, wherein less than 40 percent by weight of the nickel is substituted by at least one member selected fromm the group consisting of chromium, molybdenum, tungsten and titanium.

* * * * *